US006284989B1

(12) United States Patent
Bernier et al.

(10) Patent No.: US 6,284,989 B1
(45) **Date of Patent: *Sep. 4, 2001**

(54) MOTOR CONTROL CENTER INTERLOCK ASSEMBLY

(75) Inventors: Richard Emery Bernier; Gilbert Anthony Soares, both of Melbane, NC (US); Edgar Yee, Roanoke, VA (US)

(73) Assignee: General Electric Company, Schenectady, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/429,600

(22) Filed: Oct. 28, 1999

(51) Int. Cl.[7] ..... H01H 3/20
(52) U.S. Cl. ..... 200/50.12; 200/50.26
(58) Field of Search ..... 200/50.12, 50.32, 200/50.33, 43.16

(56) References Cited

U.S. PATENT DOCUMENTS 4,034,169 7/1977 Armstrong et al. .
4,448,450 5/1984 Kleinecke et al. .
4,448,456 5/1984 Pfundstein .
4,760,220 7/1988 Fritsch et al. .
4,806,710 2/1989 Kalvaitis et al. .
4,806,716 2/1989 Golowash .
5,019,676 5/1991 Heckenkamp .
5,642,256 * 6/1997 Pugh et al. ..... 361/615
6,028,272 * 2/2000 Akers ..... 200/50.26

* cited by examiner

*Primary Examiner*—Paul L. Gellner
*Assistant Examiner*—Nhung Nguyen
(74) *Attorney, Agent, or Firm*—Cantor Colburn LLP; Carl B. Horton

(57) ABSTRACT

A two-part motor control center interlock arrangement has a handle support plate and interlock slide positioned on an interior of the control center door operating by insertion of a tapered pin on the door interior within a key-hole slot on the interlock slide. The elongated slot of the key-hole slot automatically compensates for any tolerance accumulation between a circuit breaker handle, an interlock operating handle and the control center access door.

9 Claims, 2 Drawing Sheets

MOTOR CONTROL CENTER INTERLOCK ASSEMBLY

BACKGROUND OF THE INVENTION

This invention relates to motor control centers, and, more particularly to a motor control center interlock assembly.

Motor control centers in the form of an enclosure containing a motor starter, electric switch and a circuit breaker, such as described in U.S. patent application Ser. No. 09/347,089 entitled Motor Control Center Circuit Breaker Assembly, are interlocked to prevent opening of the enclosure unless the circuit breaker is in the OFF condition. Various interlock arrangements have been employed, U.S. Pat. No. 4,034,169 entitled Electric Switchgear Device with Interlocking Handle Means, describes an interlock operator including a link connecting between the handle of a motor control center and the circuit breaker handle operator to provide interlock function to the motor control center. U.S. Pat. No. 4,448,450 entitled Defeatable Handle and Interlock for Electrical Equipment Enclosure, describes the provision of a through-bolt for holding and releasing a two-part handle from an electrical equipment enclosure. U.S. Pat. No. 4,760,220 entitled Operator Mechanism Having Reduced Handle Throw and Improved Handle Lock, discloses an operator mechanism including a slide bar to prevent withdrawal or insertion of a removable control unit from an electrical equipment enclosure. U.S. Pat. No. 4,806,710 entitled Mechanical Door Interlock for Electrical Equipment Enclosure, describes a door interlock in the form of a drive/latch member carried by the door and a locking member carried by the enclosure to prevent opening of the enclosure door.

A more recent example of an electrical equipment enclosure interlock is described in U.S. Pat. No. 5,019,676 entitled Auxiliary Operator for Circuit Interrupting Apparatus with Interlock between Switch and Housing. A removable control unit of a motor control center is described and has an auxiliary operator handle linked to a circuit breaker handle for control of the circuit breaker externally of the motor control center. An interlock slide bar is driven by the auxiliary handle to an extended position to block removal of the unit when the circuit breaker is in the ON condition.

With the attachment of such interlock assemblies to motor control center doors, there is a need to provide for the tolerance accumulation between the interlock assembly components and the attaching means on the doors. Additionally, considerable installation time is required to position both the interlocks and the means employed to defeat the interlocks when immediate access to the control center is required.

SUMMARY OF THE INVENTION

In an exemplary embodiment of the invention, a two-part motor control center interlock arrangement has an operator support base and interlock slide positioned on the interior of the control center door by insertion of a tapered extension on the door interior within a calibrated key-shaped aperture on the interlock slide. The interlock slide is spring-loaded to a home position immediately upon insertion of the tapered extension. The elongated portion of the key-shaped aperture automatically compensates for any tolerance accumulation between the circuit breaker handle, the interlock handle operator and the control center access door. A simple means for attachment of an interlock assembly to a motor control center access door as well as automatic alignment between the circuit breaker operating handle and the circuit breaker handle defeat mechanism, during assembly, is provided by the present inventor.

DESCRIPTION OF THE PREFERRED EMBODIMENT

Figure 1:
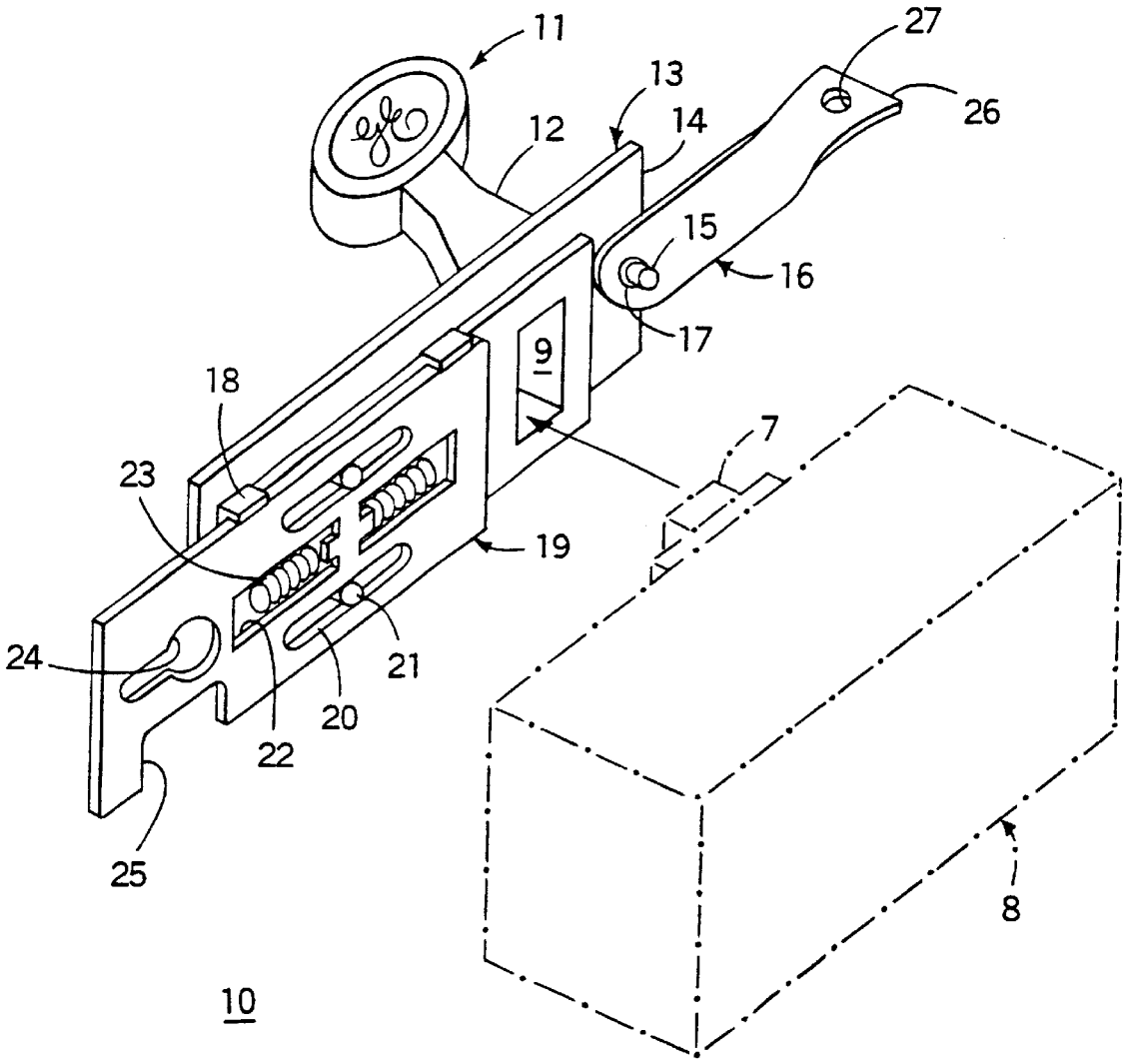
FIG. 1 is a top perspective view of the handle interlock unit of the invention in solid lines in projection from the circuit breaker unit depicted in phantom.
Figure 2:
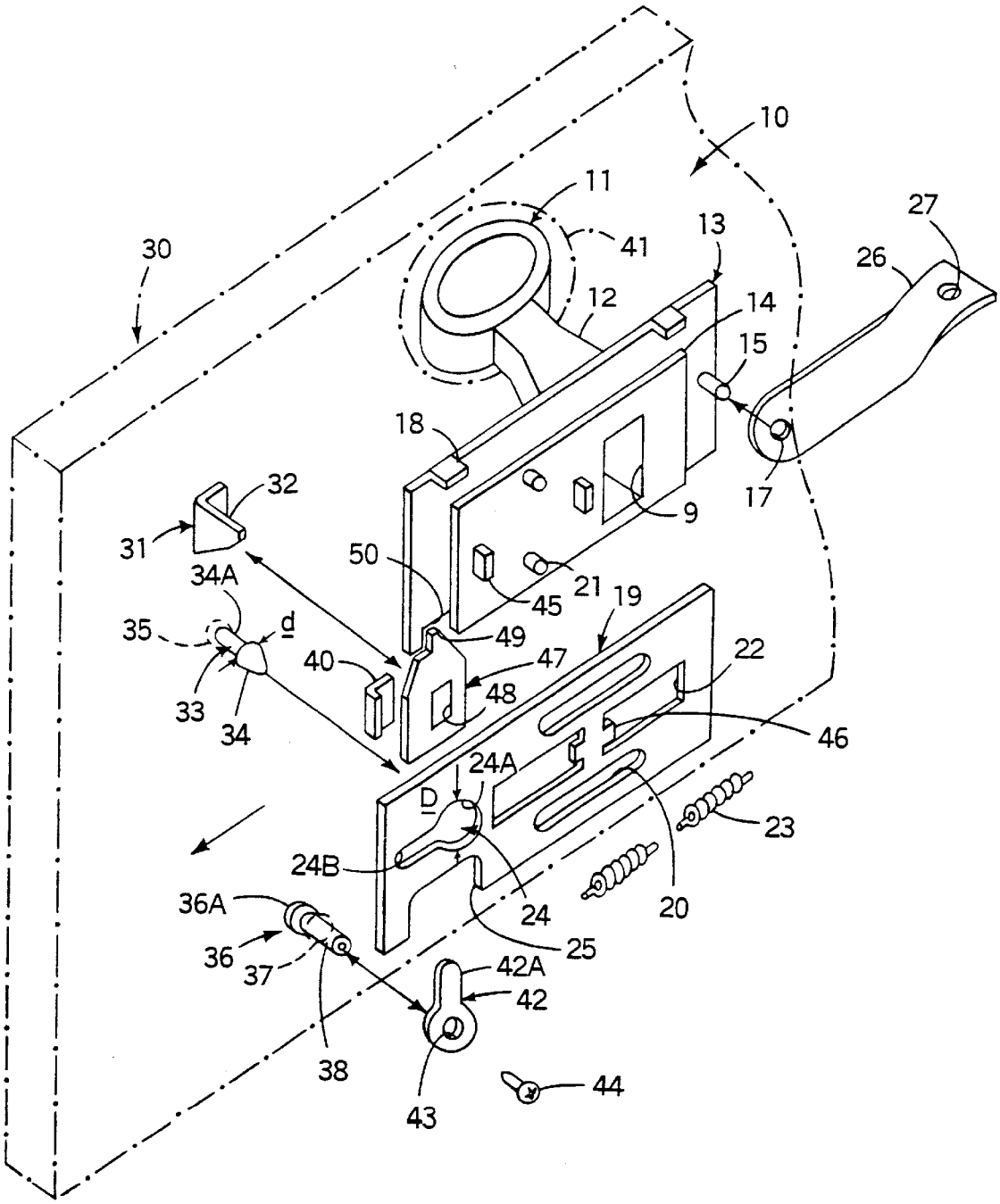
FIG. 2 is a top perspective view of the handle interlock unit of FIG. 1 with the interlock unit components in isometric projection prior to assembly onto the control center door depicted in phantom.

Referring to FIGS. 1 and 2, an electrical equipment door interlock unit 10 is generally shown. Door interlock unit 10 is used with a motor control center such as described in the aforementioned U.S. patent application Ser. No. 09/347,089 entitled Motor Control Center Circuit Breaker Assembly, which is incorporated by reference, to prevent access to the motor control equipment unless an associated circuit breaker 8 in the control center enclosure (not shown) is in the TRIPPED or OFF condition. A bucket interlock unit 16 is attached to one end of an interlock (handle) support plate 13 by insertion of a pin 15 extending from the support plate within an aperture 17 in the end of the bucket interlock unit to prevent insertion of the door interlock unit 10 in the control center enclosure, by insertion of a padlock (not shown) in an aperture 27 in a flat end 26 of the bucket interlock unit 16. An opening 9 formed in a stem 12 of an interlock unit handle operator 11 prevents translation of an interlock slide 19 along an interlock support platform 14 unless a circuit breaker handle 7 moves to the OFF position, to the right of the opening 9, as viewed in FIG. 1. The interlock slide 19 is positioned on the support platform 14 by guide tabs, as shown at 18, and includes a pair of spring retainer slots 22, containing compression springs 23 and a pair of extended rail slots 20 which encompass a pair of rail posts 21 extending from the support platform 14. A key-hole-shaped interlock slot 24 receives a tapered pin 33 extending from the inner side of a control center enclosure door 30 and a rectangular interlock defeater slot 25 receives a key-shaped interlock defeater lever 42, as shown in FIG. 2.

The inside surface of the control center enclosure door 30, shown in FIG. 2, is fitted with an angled support 31 having an angled extension 32, a U-shaped support 40 and a tapered pin 33. The tapered pin 33 is threadingly attached to the door at a threaded aperture 35 with a cone-shaped tapered end 34 arranged for being captured within the key-hole slot 24 on the door interlock unit 10. A circular aperture 24A and an elongated aperture 24B in the key-hole slot 24 operate in the manner to be described below in detail. An internally-threaded stem 38 of a defeater lever post 36 is inserted through a door aperture 37 such that a knurled end 36A remains outside the enclosure door 30 for providing manual access and the end of the threaded stem 38 extends through an aperture 43 formed within a defeater lever 42 and is fastened therein by a screw 44. When the interlock slide 19 is positioned on the handle support plate 13 an extension 42A on the defeater lever 42 is captured within the rectangular slot 25 and the angled extension 32 on the angled support 31 is captured within an operating lever slot 48 on an operating lever 47. The operating lever 47 then moves across the U-shaped support 40 with an operating lever tab 49 interacting with the handle support plate 13 by extending in a support plate slot 50. The support plate 13 is positioned against the inside surface of the enclosure door 30 with the handle operator 11 and stem 12 extending through the door aperture 41 for manual access from the exterior of the control center enclosure. The interlock slide 19 is arranged on the handle support plate 13 such that the compression springs 23 extend within the spring slots 22 and attach to spring post 45 on the support plate 13 at one end and to a spring tab 46 at the end of the spring slot 22 at the opposite end for biasing the interlock slide 19 against the handle support plate 13 for motion along the rail posts 21 within the extended rail slots 20 and the along the guide tabs 18.

An important feature of the invention is the relationship between the cone-shaped tapered end 34 on the tapered pin 33 relative to the circular aperture 24A and elongated aperture 24B in the key-shaped slot 24. The diameter d of the cone-shaped tapered end 34 is arranged for clearance relation with the diameter D of the circular aperture 24A of the key-shaped slot 24. The inclined edges of the cone-shaped tapered end 34 strike against the inner edges of the circular aperture 24A to automatically center the tapered pin within the circular aperture 24A whereby the compression springs 23 then translate the interlock slide 19 in the indicated direction along a stem 34A once the tapered end 34 clears the circular aperture 24A and the stem 34A becomes positioned within the elongated aperture 24B. The provision of the diameters D, d, and the length of the elongated aperture 24B compensate for tolerance accumulation between the components of the door interlock unit 10 on the interlock slide 19, the support plate 13 as well as on the interior of the enclosure door 30. As described earlier, the bucket in interlock unit 16 is attached to the end of the interlock support plate 13 by insertion of the pin 15 in the aperture 17.

With the door interlock unit 10 attached on the interior of the enclosure door 30 and the capture of the cone-shaped tapered end 34 of the tapered pin 33 within the key-shaped slot 24, as just described, the interlock unit handle operator 11 becomes interlocked with the circuit breaker operating handle 7 (FIG. 1) in the manner described earlier and can not be removed until and unless the circuit breaker operating handle is in the OFF position. When it is required to access the components within the motor control center when the circuit breaker operating handle is ON, rotation of the knurled end 36A of the defeater lever post 36 moves the extension 42A against the edge of the slot 25 in the clockwise direction as viewed in FIG. 2, translating the interlock slide 19 against the bias of the compression springs 23 to allow the opposite edge of the interlock slide to move the circuit breaker operating handle 7 of FIG. 2 to the OFF position.

A door interlock unit has herein been described for attaching to the interior of a motor control center enclosure door to interlock the enclosure door with the mechanical logic provided by the position of the associated circuit breaker handle within the motor control center enclosure. A tapered pin and key-shaped slot allows for wide tolerance variation between the interlock unit components while a separate defeater lever allows disengagement of the interlock under emergency conditions. Although the interlock unit is described for use with a motor control center enclosure, the interlock unit finds application with any type electrical equipment that contains an electric switch or circuit breaker within the equipment enclosure.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed for carrying out this invention, but that the invention will include all embodiments falling within the scope of the appended claims.

What is claimed is:

1. An interlock assembly for an electrical equipment enclosure comprising:

a handle support plate having an operator handle stem extending from one side and a pair of rail posts extending from an opposite side thereof, said handle support stem including an interlock operating handle formed on one end thereof;

an interlock slide having a pair of extended rail slots formed therein, said rail posts being captured within said rail slots for allowing transfer of said interlock slide along said support plate; and a key-hole slot formed within said interlock slide at on end thereof, said key-hole slot being arranged for capture of a tapered pin fastened to an inner surface of an electrical equipment enclosure access door.

2. The interlock assembly of claim 1 wherein said interlock slide further includes a pair of spring slots formed therein, each of said spring slots having a spring tab formed at one end thereof.

3. The interlock assembly of claim 2 wherein said interlock slide includes a pair of spring posts and said spring slots include a compression spring extending between said spring retainer tab and said spring posts, said compression spring arranged for biasing said interlock slide in a first direction along said support plate.

4. The interlock assembly of claim 1 including a door operator defeater slot formed within said interlock slide subjacent said key-hole slot, said operator defeater slot receiving an end of an operator defeater lever for translating said interlock slide in a second direction opposite said first direction.

5. The interlock assembly of claim 1 wherein said handle support plate includes an aperture for receiving a circuit breaker operating handle extending from a circuit breaker arranged within an electrical equipment enclosure.

6. The interlock assembly of claim 1 wherein said key-hole slot defines a circular aperture of a predetermined diameter defining a perimeter and an elongated slot connecting with said circular aperture.

7. The interlock assembly of claim 6 wherein said tapered pin defines a stem and a tapered cone having a cone base diameter smaller than a diameter of said circular aperture and cone sides extending from said cone base tapering to a point, whereby said cone sides contact a part of said perimeter to center said tapered pin within said aperture and allow said stem to become captured within said key-hole elongated slot against a compression spring bias.

8. The interlock assembly of claim 1 further including a bucket interlock unit attached to one end of said handle support plate for preventing placement of said interlock assembly within an electrical equipment enclosure.

9. The interlock assembly of claim 7 wherein said diameter of said circular aperture is in clearance relation with said cone base diameter.

* * * * *